United States Patent [19]

Nikaido et al.

[11] Patent Number: 4,760,370

[45] Date of Patent: Jul. 26, 1988

[54] RESISTOR AND AN ELECTRON TUBE INCORPORATING THE SAME

[75] Inventors: Masaru Nikaido, Miura; Yoshiaki Ouchi, Yokohama; Taketoshi Shimoma, Isezaki; Eiji Kamohara; Shigeru Sugawara, both of Fukaya; Hideki Yamaguchi, Yokohama, all of Japan

[73] Assignee: Kabushiki Kaisha Toshiba, Kawasaki, Japan

[21] Appl. No.: 66,200

[22] Filed: Jun. 25, 1987

[30] Foreign Application Priority Data

Jun. 27, 1986 [JP] Japan ..... 61-149573
Jun. 27, 1986 [JP] Japan ..... 61-149575

[51] Int. Cl.[4] ..... H01C 1/02

[52] U.S. Cl. ..... 338/308; 313/449; 338/314

[58] Field of Search ..... 338/308, 309, 314; 427/101-103, 126.2, 126.3, 126.6; 313/449

[56] References Cited

U.S. PATENT DOCUMENTS 4,139,832 2/1979 Yoshino et al. ..... 338/308
4,349,767 9/1982 Muramoto et al. ..... 338/309 X

FOREIGN PATENT DOCUMENTS 55-14627 2/1980 Japan .
56-63756 5/1981 Japan .
60-124340 7/1985 Japan .

*Primary Examiner*—C. L. Albritton
*Attorney, Agent, or Firm*—Cushman, Darby & Cushman

[57] ABSTRACT

A resistor is provided which comprises an insulation substrate, a resistive layer prepared from inorganic materials and printed on the insulation substrate, and an insulation layer prepared from borosilicate lead glass and overcoated on the resistive layer. The insulation layer contains an oxide of at least one transition metal selected from the group consisting of iron, nickel, chromium, cobalt, zinc, copper, zirconium, and cadmium. In the course of operation, the resistor of the present invention exhibits no changes in its resistance, irrespective of the length of time it may be operated.

6 Claims, 4 Drawing Sheets

RESISTOR AND AN ELECTRON TUBE INCORPORATING THE SAME

BACKGROUND OF THE INVENTION

This invention relates to a resistor and an electron tube incorporating the same. Such a resistor has a wide variety of applications. When used along with an electron gun of, for example, a color picture tube, the resistor supplies the respective electrodes with the divided levels of anode voltage. A voltage dividing resistor set forth in, for example, Japanese Patent Disclosure No. 80-14627 is of the type which is composed of an alumina ceramic insulation substrate, a resistive layer of ruthenium oxide glass resistive paste, which is printed on the insulation substrate, and an insulation layer prepared from borosilicate lead glass, which covers the resistance layer. The insulation layer contains aluminium oxide, thereby suppressing resistance variations resulting from high voltage knocking which may occur during in the manufacturing of a color picture tube.

However, a requirement of the above-mentioned type of resistor is that substantially no variation in resistance should occur while it is being operated at a high-temperature or even when the temperature of the resistor is raised by the Joule's heat. However, the conventional resistor has the drawbacks in that when used along with an electron tube, the resistor exhibits noticeable variations in resistance after it has operated for 200 to 300 hours, as represented by the broken line (curve P) of FIG. 6, and such variations in resistance are particularly noticeable in the side of a resistor which is subjected to a high potential, thereby leading to changes in the voltage-dividing ratio. In the event of such an occurrence, a noticeable change occurs in the distribution of voltage to the electrodes contained in the electron tube, with the result that the function of the electron lens and the picture quality of a color picture tube deteriorate.

SUMMARY OF THE INVENTION

This invention is intended to provide a resistor which exhibits no changes in its resistance, irrespective of the length of time it may be operated.

To attain the above-mentioned object, the present invention is intended to provide a resistance element which comprises:

an insulation substrate;

a resistive layer, prepared from inorganic materials and printed on the insulation substrate; and an insulation layer, prepared from borosilicate lead glass and over-coated on the resistive layer, and wherein the insulation layer contains an oxide of at least one transition metal selected from the group consisting of iron, nickel, chromium, cobalt, zinc, copper, zirconium, and cadmium. The present invention additiionally comprises an electron tube which incorporates this resistor.

DETAILED DESCRIPTION OF THE INVENTION

Figure 1:
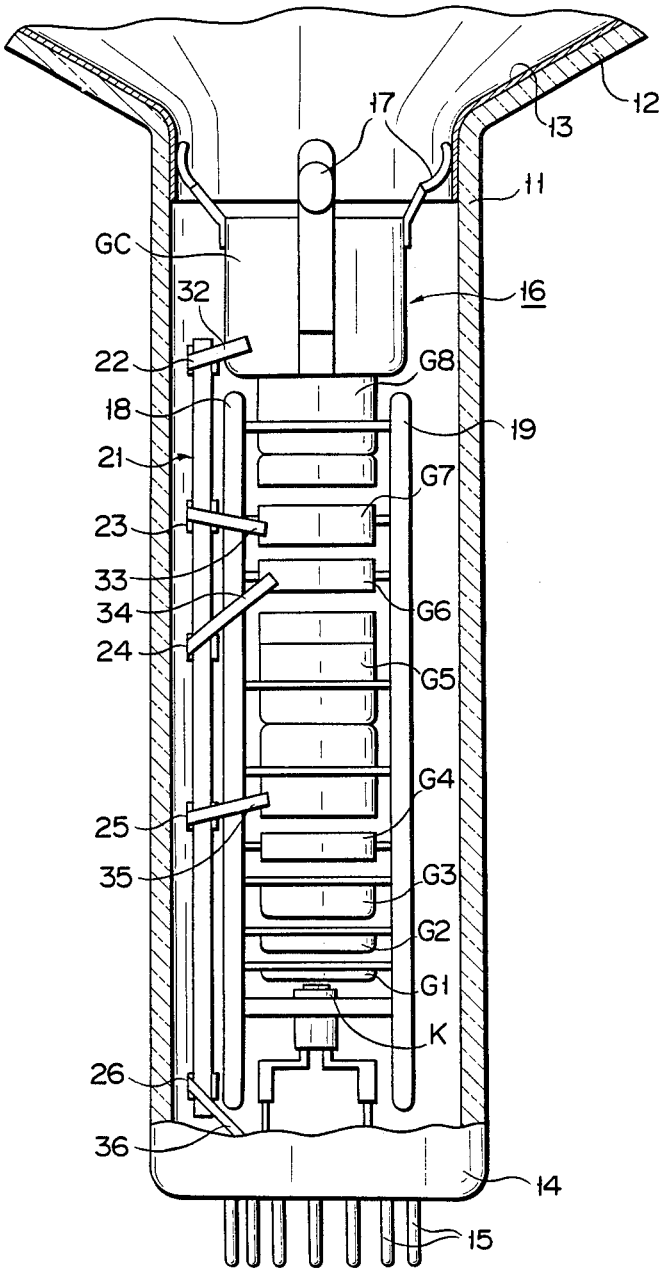
FIG. 1 is a longitudinal sectional view of an electronic tube embodying the present invention.

The present inventors studied the relationship between the properties of various oxides contained in the glass acting as an insulation layer and the factors giving rise to changes in the resistance. Before a resistor was incorporated in a color picture tube and after life test of 3000 hours, the concentrations of various elements in the section of an insulation layer was observed by an electron probe X-ray micoranalyzer (EPMA) manufactured by JEOL Corporation under the trademark "JCMA-733". As a result, the inventors assumed that in the conventional resistor comprising an insulation layer mainly consisting of borosilicate lead glass, lead oxide (PbO) contained in both resistive layer and insulation layer dissolved out from the former to the latter, resulting in resistance changes. In contract, the insulation layer of the resistor embodying the present invention contains not only borosilicate glass but also an oxide of at least one transition metal selected from the group consisting of iron, nickel, chromium, cobalt, zinc, copper, zirconium and cadmium. Therefore, we assume that the dissolution of PbO to the insulation layer is prevented.

Particularly in the case of a resistor provided with an insulation layer containing 0.5–10.0% by weight of iron oxide has its resistance variations limited within a narrower range than has been possible in the past. In this connection, it should be noted that iron oxide ($Fe_2O_3$) is an acidic oxide, whereas lead oxide is a basic oxide. Therefore, the dissolution of PbO still tends to arise between an acidic oxide and a basic oxide. Generally, divalent iron (Fe(II)) and trivalent iron (Fe(III)) constituents (respectively in the form of FeO and $Fe_2O_3$) coexist in the iron component of the insulation layer. Consequently, it is possible that the dissolution of PbO will continue until all the trivalent iron components are converted into the divalent ones. It is preferred therefore that more than 90% the iron components of the iron oxide be composed of the divalent ones.

Tests were made by incorporating various sample resistors into a color picture tubes one after another. The color picture tubes were continuously operated for 3000 hours with the anode voltage set at 30 kV. Collation was made between the rates of variations in the resistance of the respective sample resistors and state of iron component before the test was made. The measurement was made by means of an L-line characteristic X-ray spectrum of iron. Effects on the resistivity of the sample resistors caused by changes in the type of their chemical binding were sensitively indicated by variations in the wavelength and shape of said L-line characteristic X-ray spectrum of iron. Acceleration voltage was set at 10 keV. The undermentioned results were confirmed from the L-line characteristic X-ray spectrum of iron. The sample resistor which was confirmed to show a type-A spectrum (FIG. 4) before test indicated a variation of about 4% in the resistance value, and the resistance value noticeably changed particularly when operated for 200–300 hours. The sample resistor which presented a type-B spectrum (FIG. 4)

indicated changes of about 2% in the resistance value. The sample resistance element which set forth a type-C spectrum (FIG. 4) showed substantially no changes in resistance even when continuously operated for 3000 hours. FIG. 4 also shows the L-line characteristic X-ray spectra of iron prepared from FeO and $Fe_2O_3$ which were used as standard samples by way of comparison.

Figure 4:
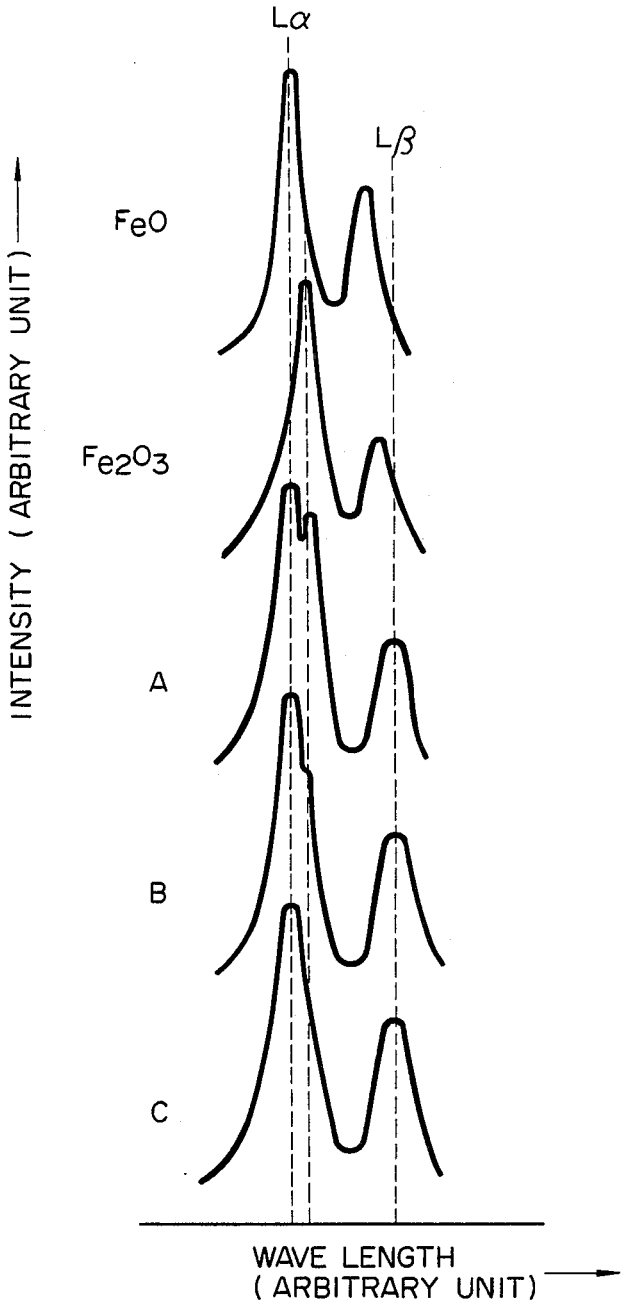
FIG. 4 sets forth the patterns of the L-line characteristic X-ray spectrum of the iron component of the iron oxide contained in the insulation layer.

The comparison given in FIG. 4 confirms that the insulation layer (of resistor) of type A contains coexisting FeO (Fe(II)) and $Fe_2O_3$ (Fe(III)); the insulation layer of type B is composed of co-existing Fe(II) and Fe(III), though the latter is contained in an small amount; and the insulation layer of type C is composed of Fe(II) alone. To minimize changes in the resistance value, therefore, it is preferred that the iron component of the iron oxide contained in the insulation layer be formed of Fe(II) alone.

Figure 5:
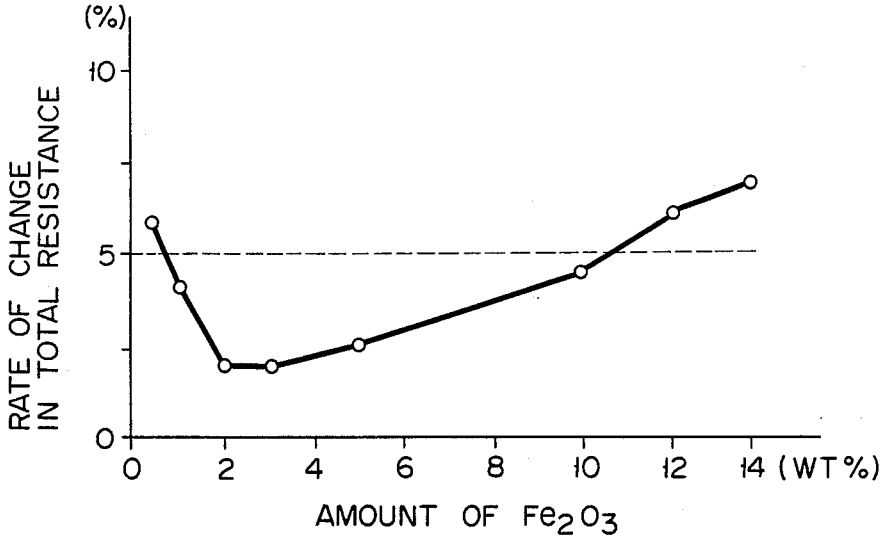
FIGS. 5 and 6 snow the relationship between the amount of $Fe_2O_3$ and the operation period, respectively, and the variations.
Figure 6:
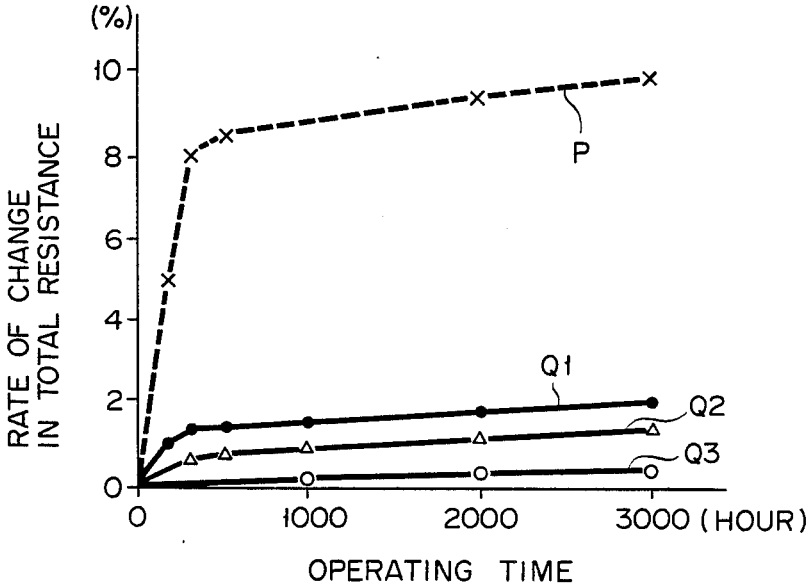

The present inventors provided various resistors which equally had a total resistance of 500 MΩ and varied only in the content of iron oxide in the insulation layer. The sample resistors were set in a color picture tube separately. The test color picture tube was operated for 3000 hours with an anode voltage of 30 kV. Variations in the total resistance of the resistor of each sample color picture tube were checked. FIG. 5 indicates the relationship between the content of $Fe_2O_3$ in the insulation layer and the rate of variations in the total resistance in the resistor after the 3000-hour operation of the sample color picture tubes, as compared with the initial resistance of said resistor. FIG. 5 proves that in case the content of $Fe_2O_3$ in the insulation layer ranges between 0.5–10% by weight, particularly between 2 and 5% by weight, variations in the total resistance of the resistor after a long operation can be reduced to such negligible level as raises no practical difficulties.

It is desired that the iron oxide involved in the insulation layer should contain more than 90% or more preferably over 95% of Fe(II). The reason is as follows. If the iron oxide involved in the insulation layer consists of 90%, 95% and 100% of Fe(II), variations in the total resistance of each sample resistance element after 3000-hour operation can be limited to about 2%, 1% and 0.5% as shown by curves $Q_1$, $Q_2$ and $Q_3$, thus proving that the resistor representing the present invention indicates a tremendously great difference from the conventional type shown by curve P.

If it is desired to convert more than 90% of iron constituting the iron oxide of the insulation layer to Fe(II), it is advised to apply heat treatment to iron oxide in an atmosphere containing hydrogen, thereby reducing Fe(III) into Fe(II).

DETAILED DESCRIPTION OF THE PREFEERRED EMBODIMENTS

Figure 2:
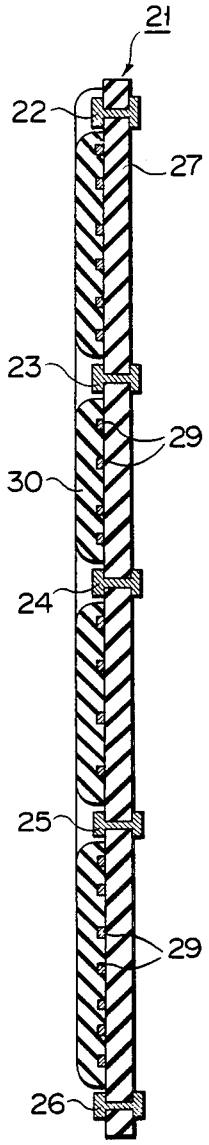
FIGS. 2 and 3 are respectively the longitudinal sectional view of the resistor and the plan perspective view thereof.
Figure 3:
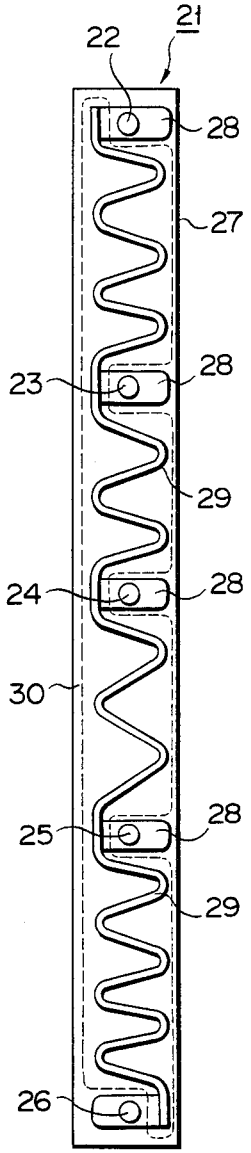

Description may now be made with reference to FIGS. 2 and 3 of a resistor representing the present invention. There were provided island shaped electrode layers 28 of low resistivity and stainless steel terminals 22, 23, 24, 25 and 26 each consisting of a penetrating pin. Later, resistive material composed of ruthenium oxide power, lead oxide power and an inorganic vitreous powder mixture mainly consisting of silica was screen-printed to one plane of the surface of substrate 27 in the zigzag pattern to provide an integral meandering resistive layer 29. A plurality of electrode layers 28 were each mainly composed of ruthenium oxide powder, lead oxide powder and silica like the resistance layer 29. In the case of electrode layer 28, the ratio of ruthenium oxide/vitreous component was made larger than in resistive layer 29, thereby reducing resistance. Later, insulative substrate 27 on which resistive layer 29 and a plurality of electrodes 28 were screen-printed was fired at a temperature of 950° C. in air. Later, the resistive layer 29 had its resistivity adjusted to 500 MΩ by laser trimming. Then borosilicate glass paste prepared from 10% by weight of $B_2O_3$, 27% by weight of $SiO_2$, 55% by weight of PbO, 5% by weight of $Al_2O_3$ and 3% by weight of $Fe_2O_3$ was over-coated to the surface of resistive layer 29 except terminals 22–26. Then this paste was fired in air at 600° C. for 30 minutes, and then in an atmosphere of nitrogen containing 10% by volume of hydrogen at 450° C. for 30 hours. As a result, resistor 21 coated with vitreous insulation layer 30 was produced. In this product, the $Fe_2O_3$ was entirely converted into the FeO.

Resistor 21 was incorporated in the electron gun structure electrically connected to the electron lens electrode and the terminals of a color picture tube, which was continuously operated for 3000 hours. In this case, little change was observed in the resistivity of resistor 21.

The insulation substrate may be prepared from vitreous material or ceramic mainly prepared from aluminium oxide and in addition from silica, magnesium oxide, calcium oxide, etc.. The resistive layer may contain titanium oxide, aluminium oxide, bismuth oxide, etc.

FIG. 1 illustrates resistor 21 incorporated to a color picture tube 40. The inner wall of funnel section 12 of evacuated glass vessel 11 is coated with anode layer 13. The bottom portion of glass vessel 11 comprises stem section 14 and external leads 15. Vessel 11 contains electron gun 16, its cathode K, first to eighth grids $G_1$–$G_8$, convergence electrode Gc, spring contact member 17 and a pair of electrode-supporting insulation bead glass members 18 and 19. Three sets of said electrode are provided to match the three primary colors. In part of electron gun 16, resistance dividing resistor 21 fixedly extends along the outside of bead glass 18. High voltage terminal 22 of resistance element 21 is connected to convergence electrode Gc. Partial pressure intermediate terminals 23, 24, 25 are electrically connected to seventh grid $G_7$, sixth grid $G_6$ and fifth grid $G_5$, respectively, by means of lead lines 33–35. Low voltage terminal 26 of resistance dividing resistor 21 lying on the side of stem 14 is connected to one of external leads 15.

Thus, anode voltage is divided to grids $G_7$, $G_6$ and $G_5$ in the predetermined divided ratio by means of resistance dividing resistor 21, thereby constituting the required electron lens system.

It has been experimentally confirmed that in the color picture tube 40 embodying the present invention, the divided potentials supplied to grids $G_7$, $G_6$ and $G_5$ indicate substantially no change, no matter how long the subject color picture tube is operated.

What is claimed is:

1. A resistor which comprises:

an insulation substrate;

a resistive layer prepared from inorganic materials and printed on said insulation substrate;

and an insulation layer prepared from borosilicate lead glass and over-coated on said resistive layer and containing iron oxide and an oxide of at least one transition metal selected from the group consisting of nickel, chromium, cobalt, zinc, copper, zirconium, and cadmium.

2. The resistor according to claim 1, wherein the content of iron oxide accounts for 0.5–10.0% of the total weight of the insulation layer.

3. The resistor according to claim 2, wherein the iron component of the iron oxide consists of more than 90% Fe(II).

4. An electron tube wherein the resistor comprises:

a plurality of electrodes arranged in an evacuated vessel;

an insulation substrate which is formed in the evacuated vessel and whose partial pressure terminals are connected to said electrodes;

a resistive layer prepared from inorganic materials and printed on the insulation substrate; and an insulation layer prepared from borosilicate lead glass and over-coated on said resistive layer; and wherein said insulation layer contains iron oxide and an oxide of at least one transition metal selected from the group consisting of nickel, chromium, cobalt, zinc, copper, zirconium, and cadmium.

5. An electron tube according to claim 4, wherein the content of iron oxide accounts for 0.5–10.0% of the total weight of the insulation layer.

6. An electron tube according to claim 5, wherein the iron component of the iron oxide consists of more than 90% Fe(II).

* * * * *